US008939532B2

(12) United States Patent
Ono et al.

(10) Patent No.: US 8,939,532 B2
(45) Date of Patent: Jan. 27, 2015

(54) INKJET HEAD DRIVING METHOD AND DRIVING DEVICE

(71) Applicants: Kabushiki Kaisha Toshiba, Minato-ku, Tokyo (JP); Toshiba Tec Kabushiki Kaisha, Shinagawa-ku, Tokyo (JP)

(72) Inventors: Shunichi Ono, Shizuoka-ken (JP); Teruyuki Hiyoshi, Shizuoka-ken (JP); Mamoru Kimura; Noboru Nitta, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/100,270

(22) Filed: Dec. 9, 2013

(65) Prior Publication Data

US 2014/0176627 A1 Jun. 26, 2014

(30) Foreign Application Priority Data

Dec. 26, 2012 (JP) ..... 2012-283481

(51) Int. Cl.
*B41J 29/38* (2006.01)
*B41J 2/045* (2006.01)

(52) U.S. Cl.
CPC ..... *B41J 2/04541* (2013.01); *B41J 2/04573* (2013.01); *B41J 2/04581* (2013.01); *B41J 2/04596* (2013.01); *B41J 2202/10* (2013.01)
USPC ..... 347/10; 347/68

(58) Field of Classification Search
CPC ..... B41J 2/04541; B41J 2/04573; B41J 2/04581; B41J 2/04588; B41J 2/04598
USPC ..... 347/9–11, 68, 69
See application file for complete search history.

(56) References Cited

U.S. PATENT DOCUMENTS

| | | | | |
|---|---|---|---|---|
| 6,113,209 | A * | 9/2000 | Nitta et al. | 347/9 |
| 6,736,479 | B2 * | 5/2004 | Baba et al. | 347/19 |
| 8,277,008 | B2 * | 10/2012 | Tsukamoto | 347/10 |
| 2006/0284911 | A1 | 12/2006 | Norigoe | |

* cited by examiner

*Primary Examiner* — An Do
(74) *Attorney, Agent, or Firm* — Amin, Turocy & Watson, LLP

(57) ABSTRACT

According to one embodiment, a driving device applies an ejection pulse signal that deforms a partition in such a way that an ink drop is ejected from a nozzle and an auxiliary pulse signal that deforms the partition to such an extent that an ink drop is not ejected from the nozzle, as a drive signal for providing a potential difference between electrodes, to an inkjet head at different timings so that the two pulse signals are not applied simultaneously. A constraint on output of the auxiliary pulse signal is significantly relaxed.

12 Claims, 14 Drawing Sheets

FIG. 11

| WAVEFORM FRAME NUMBER | | W0 | W1 | W2 | W3 | W4 | W5 | W6 | W7 | W8 | W9 | W10 | W11 | W12 | W13 | W14 | W15 |
|---|---|---|---|---|---|---|---|---|---|---|---|---|---|---|---|---|---|
| DROP NUMBER | | 0 | 1 | 2 | 3 | 4 | 5 | 6 | 7 | 8 | 9 | 10 | 11 | 12 | 13 | 14 | 15 |
| TIMER SET | | T | T | T | T | T | T | T | T | T | T | T | T | T | T | T | T |
| M1 | | | | | | | | | | | | | | | | | |
| FULL-BOOST ADVANCE REFERENCE MODE | 1h | BST | ACT | NEG | NEG | NEG | NEG | NEG | NEG | NEG | NEG | NEG | NEG | NEG | NEG | NEG | NEG |
| | ⋮ | | | | | | | | | | | | | | | | |
| | 7h | BST | ACT | ACT | ACT | ACT | ACT | ACT | ACT | NEG | NEG | NEG | NEG | NEG | NEG | NEG | NEG |
| | 8h | BST | ACT | ACT | ACT | ACT | ACT | ACT | ACT | ACT | NEG | NEG | NEG | NEG | NEG | NEG | NEG |
| | ⋮ | | | | | | | | | | | | | | | | |
| | Fh | BST | ACT | ACT | ACT | ACT | ACT | ACT | ACT | ACT | ACT | ACT | ACT | ACT | ACT | ACT | ACT |
| M2 | | | | | | | | | | | | | | | | | |
| FULL-BOOST AFTER-REFERENCE MODE | 1h | NEG | NEG | NEG | NEG | NEG | NEG | NEG | NEG | NEG | NEG | NEG | NEG | NEG | NEG | BST | AVT |
| | ⋮ | | | | | | | | | | | | | | | | |
| | 7h | NEG | NEG | NEG | NEG | NEG | NEG | NEG | NEG | BST | ACT | ACT | ACT | ACT | ACT | ACT | ACT |
| | 8h | NEG | NEG | NEG | NEG | NEG | NEG | NEG | BST | ACT | ACT | ACT | ACT | ACT | ACT | ACT | ACT |
| | ⋮ | | | | | | | | | | | | | | | | |
| | Fh | BST | ACT | ACT | ACT | ACT | ACT | ACT | ACT | ACT | ACT | ACT | ACT | ACT | ACT | ACT | ACT |
| M3 | | | | | | | | | | | | | | | | | |
| FULL-DUMP ADVANCE REFERENCE MODE | 1h | ACT | DNP | NEG | NEG | NEG | NEG | NEG | NEG | NEG | NEG | NEG | NEG | NEG | NEG | NEG | NEG |
| | ⋮ | | | | | | | | | | | | | | | | |
| | 7h | ACT | ACT | ACT | ACT | ACT | ACT | ACT | DNP | NEG | NEG | NEG | NEG | NEG | NEG | NEG | NEG |
| | 8h | ACT | ACT | ACT | ACT | ACT | ACT | ACT | ACT | DNP | NEG | NEG | NEG | NEG | NEG | NEG | NEG |
| | ⋮ | | | | | | | | | | | | | | | | |
| | Fh | ACT | ACT | ACT | ACT | ACT | ACT | ACT | ACT | ACT | ACT | ACT | ACT | ACT | ACT | ACT | DNP |
| M4 | | | | | | | | | | | | | | | | | |
| FULL-DUMP AFTER-REFERENCE MODE | 1h | NEG | NEG | NEG | NEG | NEG | NEG | NEG | NEG | NEG | NEG | NEG | NEG | NEG | NEG | ACT | DNP |
| | ⋮ | | | | | | | | | | | | | | | | |
| | 7h | NEG | NEG | NEG | NEG | NEG | NEG | NEG | NEG | ACT | ACT | ACT | ACT | ACT | ACT | ACT | DNP |
| | 8h | NEG | NEG | NEG | NEG | NEG | NEG | NEG | ACT | ACT | ACT | ACT | ACT | ACT | ACT | ACT | DNP |
| | ⋮ | | | | | | | | | | | | | | | | |
| | Fh | ACT | ACT | ACT | ACT | ACT | ACT | ACT | ACT | ACT | ACT | ACT | ACT | ACT | ACT | ACT | DNP |

FIG. 12

| WAVEFORM FRAME NUMBER | | W0 | W1 | W2 | W3 | W4 | W5 | W6 | W7 | W8 | W9 | W10 | W11 | W12 | W13 | W14 | W15 |
|---|---|---|---|---|---|---|---|---|---|---|---|---|---|---|---|---|---|
| DROP NUMBER | | 0 | 1 | 2 | 3 | 4 | 5 | 6 | 7 | 8 | 9 | 10 | 11 | 12 | 13 | 14 | 15 |
| TIMER SET (FULL-BOOST) | | Ta | Tb | Tb | Tb | Tb | Tb | Tb | Tb | Tb | Tb | Tb | Tb | Tb | Tb | Tb | Tb |
| TIMER SET (FULL-DUMP) | | Tb | Tb | Tb | Tb | Tb | Tb | Tb | Tb | Tb | Tb | Tb | Tb | Tb | Tb | Tb | Tc |
| M1 | | | | | | | | | | | | | | | | | |
| FULL-BOOST ADVANCE REFERENCE MODE | 1h | BST | ACT | NEG | NEG | NEG | NEG | NEG | NEG | NEG | NEG | NEG | NEG | NEG | NEG | NEG | NEG |
| | ⋮ | | | | | | | | | | | | | | | | |
| | 7h | BST | ACT | ACT | ACT | ACT | ACT | ACT | ACT | NEG | NEG | NEG | NEG | NEG | NEG | NEG | NEG |
| | 8h | BST | ACT | ACT | ACT | ACT | ACT | ACT | ACT | ACT | NEG | NEG | NEG | NEG | NEG | NEG | NEG |
| | ⋮ | | | | | | | | | | | | | | | | |
| | Fh | BST | ACT | ACT | ACT | ACT | ACT | ACT | ACT | ACT | ACT | ACT | ACT | ACT | ACT | ACT | ACT |
| M4 | | | | | | | | | | | | | | | | | |
| FULL-DUMP AFTER-REFERENCE MODE | 1h | NEG | NEG | NEG | NEG | NEG | NEG | NEG | NEG | NEG | NEG | NEG | NEG | NEG | NEG | ACT | DNP |
| | ⋮ | | | | | | | | | | | | | | | | |
| | 7h | NEG | NEG | NEG | NEG | NEG | NEG | NEG | NEG | ACT | ACT | ACT | ACT | ACT | ACT | ACT | DNP |
| | 8h | NEG | NEG | NEG | NEG | NEG | NEG | NEG | ACT | ACT | ACT | ACT | ACT | ACT | ACT | ACT | DNP |
| | ⋮ | | | | | | | | | | | | | | | | |
| | Fh | ACT | ACT | ACT | ACT | ACT | ACT | ACT | ACT | ACT | ACT | ACT | ACT | ACT | ACT | ACT | DNP |

FIG. 13

| WAVEFORM FRAME NUMBER | W0 | W1 | W2 | W3 | W4 | W5 | W6 | W7 |
|---|---|---|---|---|---|---|---|---|
| No.0 ADJACENT UNITS ON BOTH SIDES | NEGINA | NEGINA | NEGINA | NEGINA | NEGINA | NEGINA | NEGINA | NEGINA |
| No.1 UNIT CONCERNED GRADATION VALUE0h | NEG | NEG | NEG | NEG | NEG | NEG | NEG | NEG |
| No.2 ADJACENT UNITS ON BOTH SIDES | NEGINA | NEGINA | NEGINA | NEGINA | NEGINA | NEGINA | NEGINA | NEGINA |
| No.3 ADJACENT UNITS ON BOTH SIDES | BSTINA | INA | INA | INA | NEGINA | NEGINA | NEGINA | NEGINA |
| No.4 UNIT CONCERNED GRADATION VALUE3h | BST | ACT | ACT | ACT | NEG | NEG | NEG | NEG |
| No.5 ADJACENT UNITS ON BOTH SIDES | BSTINA | INA | INA | INA | NEGINA | NEGINA | NEGINA | NEGINA |
| No.6 ADJACENT UNITS ON BOTH SIDES | BSTINA | INA | INA | INA | INA | INA | INA | INA |
| No.7 UNIT CONCERNED GRADATION VALUE7h | BST | ACT | ACT | ACT | ACT | ACT | ACT | ACT |
| No.8 ADJACENT UNITS ON BOTH SIDES | BSTINA | INA | INA | INA | INA | INA | INA | INA |

INKJET HEAD DRIVING METHOD AND DRIVING DEVICE

CROSS-REFERENCE TO RELATED APPLICATION

This application is based upon and claims the benefit of priority from Japanese Patent Application No. 2012-283481, filed Dec. 26, 2012, the entire contents of which are incorporated herein by reference.

FIELD

Embodiments described herein relate generally to a driving method and driving device for a share mode type inkjet head in which an actuator is shared between adjacent ink chambers.

BACKGROUND

The driving device applies an ejection pulse signal and an auxiliary pulse signal as drive signals to the share mode type inkjet head. The ejection pulse signal drives the actuator in such a way that a drop of ink (ink drop) is ejected from a nozzle. The auxiliary pulse signal drives the actuator to such an extent that no ink is ejected.

There is a multi-drop driving system as an inkjet head driving system. In this driving system, one pixel is formed with one to plural ink drops, thus expressing gradation. The driving device continuously outputs an ejection pulse signal to the actuator by the number of drops corresponding to the gradation value of the pixel. Also, in order to generate preliminary vibration of the actuator, the driving device outputs an auxiliary pulse signal immediately before the ejection pulse signal for the first drop. Such an auxiliary pulse signal is referred to as a boost signal (BST). Alternatively, in order to absorb the vibration of the actuator after ink ejection, the driving device outputs an auxiliary pulse signal immediately after the ejection pulse signal for the last drop. Such an auxiliary pulse signal is referred to as a dump signal (DMP).

In the share mode type inkjet head, an actuator is shared between adjacent ink chambers. That is, ink chambers that are not at the ends of the head share have a first actuator shared with an ink chamber adjacent thereto on one side, and a second actuator shared with an ink chamber adjacent thereto on the other side. Therefore, when an ink drop is ejected from a nozzle communicating with the ink chamber concerned, the one actuator shared with the ink chamber concerned in the adjacent ink chambers on both sides of the ink chamber concerned is actuated as well. At this time, if the other actuator is also actuated in the two adjacent ink chambers, the ink may be ejected erroneously. Thus, the driving device needs to drive the two ink chambers sharing the other actuator, simultaneously with the same electric potential so that the other actuator is not actuated.

In this way, the driving device outputs a drive pulse signal synchronously with an ejection pulse signal also to the ink chamber communicating with the nozzle that does not eject ink drops. Meanwhile, the driving device properly outputs an auxiliary pulse signal to the nozzle that does not eject ink drops. Therefore, the driving device can only output an auxiliary pulse signal in a section that excludes a section where the drive pulse signal must be outputted, from one cycle of the ejection pulse signal.

DESCRIPTION OF THE DRAWINGS

FIG. 11 is a schematic view showing an example of a pattern of gradation-specific drive signal in an auxiliary operation mode.

FIG. 12 is a schematic view showing the correspondence between the auxiliary operation mode and timer set used in an embodiment.

FIG. 13 is a schematic view showing an example of a principal drive signal in a full-boost advance reference mode.

DETAILED DESCRIPTION

In general, according to one embodiment, a driving method for an inkjet head includes applying an ejection pulse signal that deforms a partition in such a way that an ink drop is ejected from a nozzle and an auxiliary pulse signal that deforms the partition to such an extent that an ink drop is not ejected from the nozzle, as a drive signal for providing a potential difference between electrodes, to the inkjet head at different timings so that the two pulse signals are not applied simultaneously, and thereby driving the inkjet head.

Hereinafter, an embodiment of a driving device and driving method for an inkjet head will be described with reference to the drawings.

This embodiment is the case where the technique is applied to a share mode type line inkjet head 100.

First Embodiment

Figure 1:
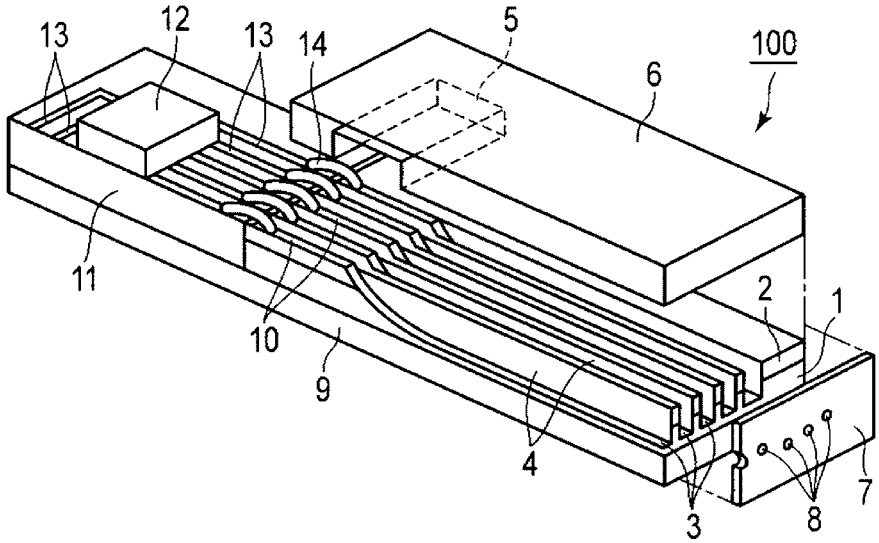
FIG. 1 is a partly exploded perspective view showing a line inkjet head.
Figure 2:
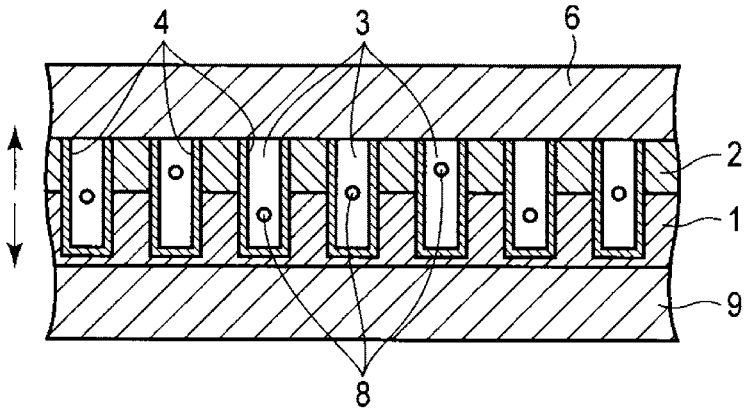
FIG. 2 is a lateral sectional view of a forward portion of the line inkjet head.
Figure 3:
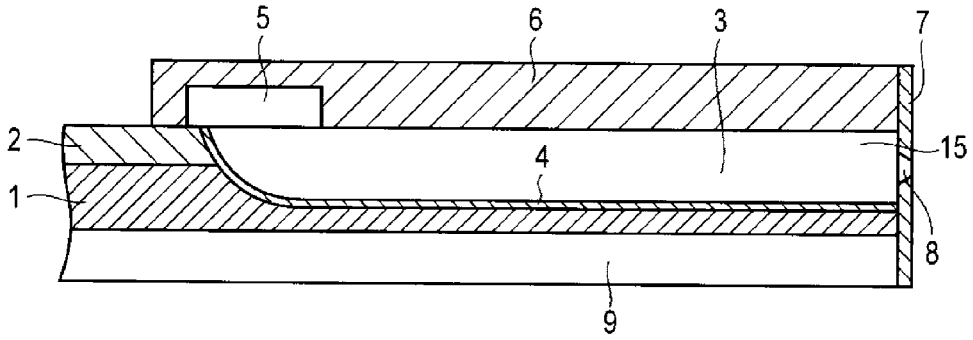
FIG. 3 is a longitudinal sectional view of a forward portion of the line inkjet head.

First, the configuration of the line inkjet head 100 (hereinafter simply referred to as the head 100) will be described with reference to FIGS. 1 to 3. FIG. 1 is a partly exploded perspective view showing the head 100. FIG. 2 is a lateral sectional view showing a forward portion of the head 100. FIG. 3 is a longitudinal sectional view showing a forward portion of the head 100.

The head 100 has a base substrate 9. In the head 100, a first piezoelectric member 1 is joined to an upper surface on the forward side of the base substrate 9, and a second piezoelectric member 2 is joined onto this first piezoelectric member 1. The first piezoelectric member 1 and the second piezoelectric member 2 joined together are polarized in the opposite directions to each other along a direction of plate thickness as indicated by arrows in FIG. 2.

The head 100 is provided with a number of elongate grooves 3 from the distal end side of the joined piezoelectric members 1, 2 toward the rear end side. The respective grooves 3 are at a constant interval and parallel to each other. Each groove 3 is opened at the distal end and inclined upward at the rear end.

In the head 100, an electrode 4 is provided on sidewalls and bottom surface of each groove 3. Moreover, in the head 100, an extraction electrode 10 is provided from the rear end of each groove 3 toward a rear upper surface of the second piezoelectric member 2. The extraction electrode 10 extends from the electrode 4.

In the head 100, the upper part of each groove 3 is closed by a top plate 6 and the distal end of each groove 3 is closed by an orifice plate 7. The top plate 6 has a common ink chamber 5 in an inner rear part thereof.

In the head 100, the respective grooves 3 surrounded by the top plate 6 and the orifice plate 7 form plural ink chambers 15. The ink chambers 15 are also called pressure chambers. In the head 100, a nozzle 8 is opened at a position facing each groove 3 in the orifice plate 7. The nozzle 8 communicates with the groove 3 that the nozzle 8 faces, that is, the ink chamber 15.

In the head 100, a printed board 11 with a conductor pattern 13 formed thereon is joined to an upper surface on the rear side of the base substrate 9. Then, in the head 100, a drive IC 12 in which a driving device, later described, is mounted, is installed on this printed board 11. The drive IC 12 connects to the conductor pattern 13. The conductor pattern 13 is wire-bonded to each extraction electrode 10 with a conductor wire 14.

Next, the operation principle of the head 100 configured as described above will be described with reference to FIGS. 4A to 4C.

Figure 4A:
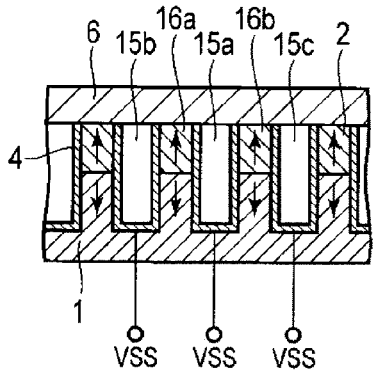
FIGS. 4A to 4C are explanatory views of the operation principle of the line inkjet head.

FIG. 4A shows the state where the electric potential of the electrode 4 provided on each wall surface of a center ink chamber 15*a* and adjacent ink chambers 15*b*, 15*c* on both sides of the ink chamber 15*a* is a ground voltage VSS. In this state, neither a partition 16*a* between the ink chamber 15*a* and the ink chamber 15*b* nor a partition 16*b* between the ink chamber 15*a* and the ink chamber 15*c* is subject to any straining.

Figure 4B:
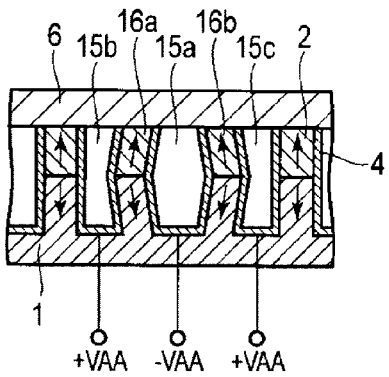

FIG. 4B shows the state where a negative voltage −VAA is applied to the electrode 4 of the center ink chamber 15*a*, whereas a positive voltage +VAA is applied to the electrodes 4 of the adjacent ink chambers 15*b*, 15*c* on both sides. In this state, an electric field acts on the respective partitions 16*a*, 16*b* in a direction orthogonal to the polarization direction of the piezoelectric members 1, 2. This action deforms the respective partitions 16*a*, 16*b* outward in such a way as to expand the capacity of the ink chamber 15*a*.

Figure 4C:
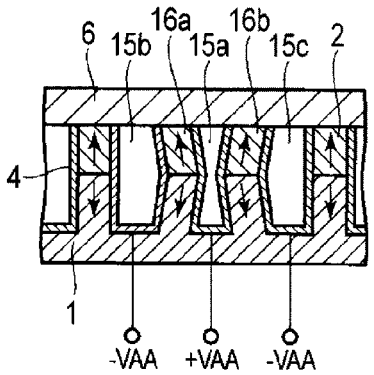

FIG. 4C shows the state where a positive voltage +VAA is applied to the electrode 4 of the center ink chamber 15*a*, whereas a negative voltage −VAA is applied to the electrodes 4 of the adjacent ink chambers 15*b*, 15*c* on both sides. In this state, an electric field acts on the respective partitions 16*a*, 16*b* in the opposite direction to the case of FIG. 4B. This action deforms the respective partitions 16*a*, 16*b* inward in such a way as to reduce the capacity of the ink chamber 15*a*.

When the capacity of the ink chamber 15*a* is expanded or reduced, pressure vibration occurs inside the ink chamber 15*a*. This pressure vibration raises pressure inside the ink chamber 15*a*, causing an ink drop to be ejected from the nozzle 8 communicating with the ink chamber 15*a*.

In this way, the partitions 16*a*, 16*b* separating the respective ink chambers 15*a*, 15*b*, 15*c* become actuators for providing pressure vibration inside the ink chamber 15*a* having the partitions 16*a*, 16*b* as wall surfaces thereof. Thus, each ink chamber 15 shares an actuator with the adjacent ink chambers 15. Therefore, the driving device of the head 100 cannot drive each ink chamber 15 separately. The driving device drives the respective ink chambers 15, dividing the respective ink chambers 15 with n ink chambers apart (n being an integer equal to or greater than 2) into groups of (n+1) ink chambers. This embodiment shows an example of so-called three-division driving, where the driving device drives the respective ink chambers 15 with two ink chambers apart into groups of three. It should be noted that three-division driving is simply an example and four-division driving or five-division driving may also be employed.

The relation between a change in the state of each ink chamber 15 when the head 100 is driven in three-division driving and the drive pulse voltage applied to the electrode 4 of each ink chamber 15 in accordance with the change in the state will be described with reference to FIGS. 5 and 6. In the drawings, a nozzle No.i (i=0 to 8) is a unique number allocated to the nozzle 8 communicating with each corresponding ink chamber 15. In this embodiment, nozzle No.i=0, 1, 2, 3 . . . is appended to each nozzle 8 in order from the left as viewed from outside the orifice plate 7. Hereinafter, for convenience of explanation, a nozzle 8 with nozzle No.i attached thereto is indicated by a reference number 8-i, and the ink chamber 15 communicating with this nozzle 8-i is indicated by a reference number 15-i. Also, the partition separating an ink chamber 15-(i−1) and the ink chamber 15-i is indicated by a reference number 16-(i−1)i.

Figure 5:
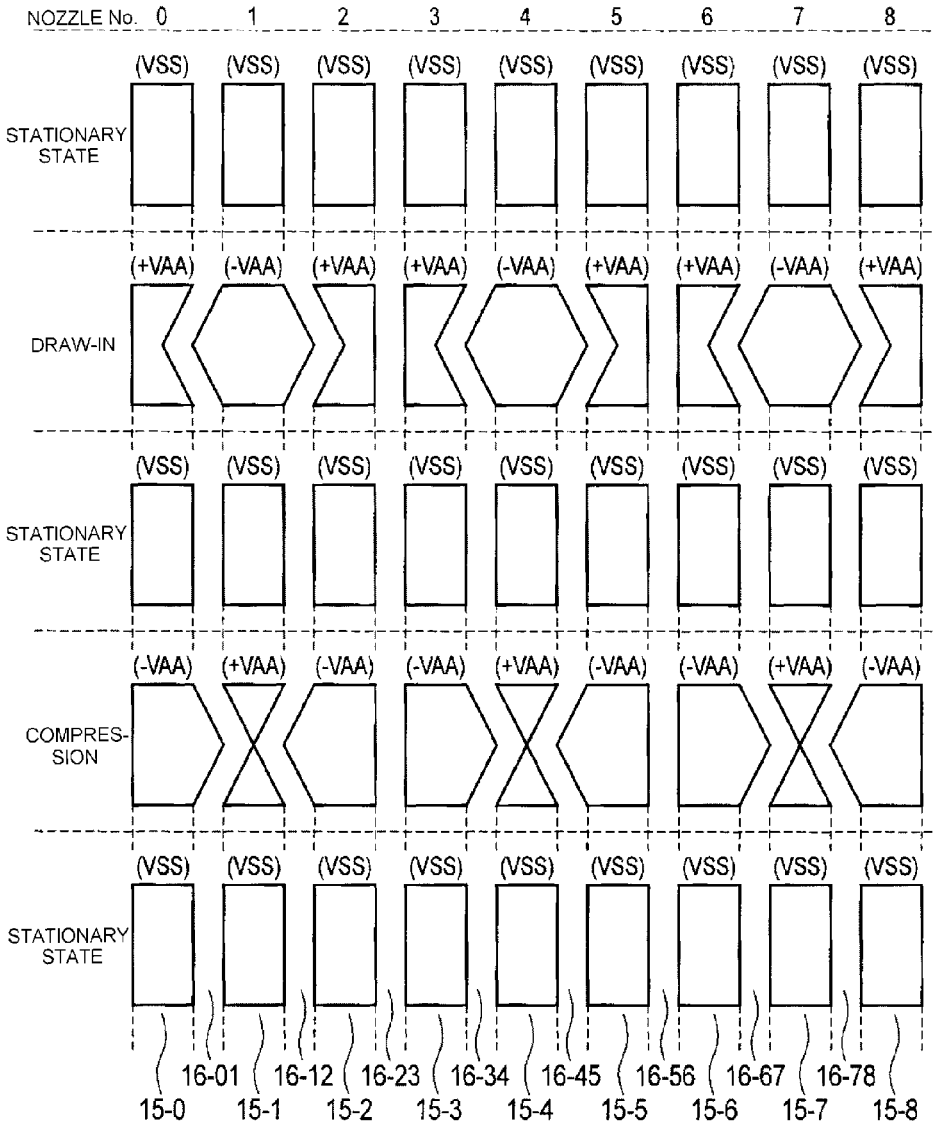
FIG. 5 is a schematic view showing an example of the relation between the state of ink chamber and drive pulse voltage when the line inkjet head is driven in three-division driving.
Figure 6:
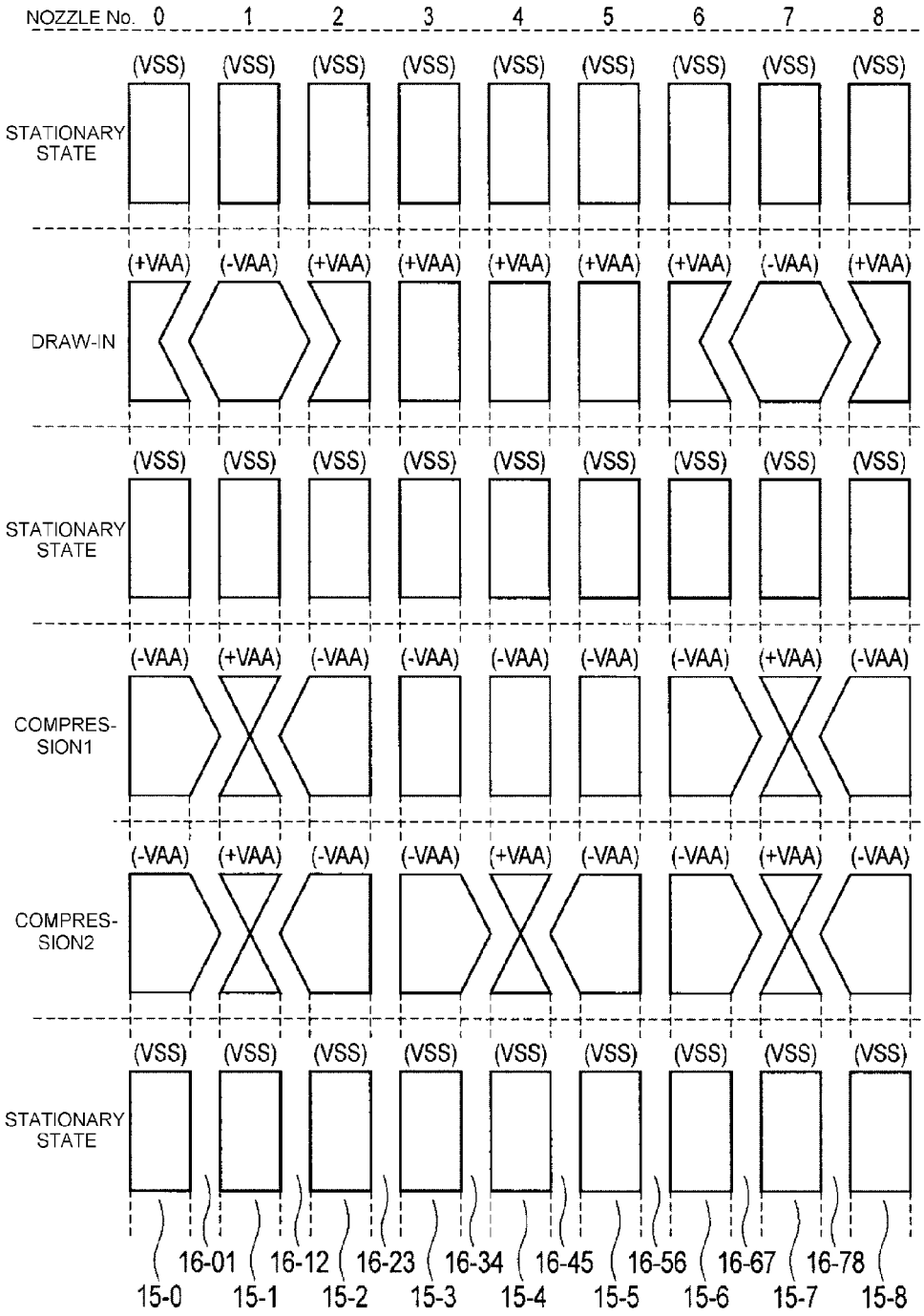
FIG. 6 is a schematic view showing another example of the relation between the state of ink chamber and drive pulse voltage when the line inkjet head is driven in three-division driving.

In FIGS. 5 and 6, ink chambers 15-0, 15-3, 15-6 communicating respectively with nozzles 8-0, 8-3, 8-6 with nozzle Nos.i=0, 3, 6 are in the same group. Ink chambers 15-1, 15-4, 15-7 communicating respectively with nozzles 8-1, 8-4, 8-7 with nozzle Nos.i=1, 4, 7 are in the same group. Ink chambers 15-2, 15-5, 15-8 communicating respectively with nozzles 8-2, 8-5, 8-8 with nozzle Nos.i=2, 5, 8 are in the same group.

FIG. 5 shows the case where an ink drop is ejected from the respective nozzles 8-1, 8-4, 8-7 with nozzle Nos.i=1, 4, 7. In this case, the respective ink chambers 15-0 to 15-8 change in order of stationary state, lead-in state, stationary state, compressive state, and stationary state, according to one cycle of ejection pulse signal.

In the stationary state, the driving device gives a ground voltage VSS to the electrodes 4 of the respective ink chambers 15-0 to 15-8. In the lead-in state, the driving device applies a negative voltage −VAA to each electrode 4 of the ink chambers 15-1, 15-4, 15-7 that are ink ejection targets, and applies a positive voltage +VAA to each electrode of the respective ink chambers 15-0, 15-2, 15-3, 15-5, 15-6, 15-8 arranged adjacently on both sides of the ink chambers 15-1, 15-4, 15-7. That is, the pattern shown in FIG. 4B is employed. On the other hand, in the compressive state, the driving device applies a positive voltage +VAA to each electrode 4 of the ink chambers 15-1, 15-4, 15-7 and applies a negative voltage −VAA to each electrode 4 of the ink chambers 15-0, 15-2, 15-3, 15-5, 15-6, 15-8. That is, the pattern shown in FIG. 4C is employed.

That is, the driving device applies an ejection pulse signal (ejection drive signal for unit concerned) that changes in order of ground voltage VSS, negative voltage −VAA, ground voltage VSS, positive voltage +VAA, and ground voltage VSS, to the electrodes 4 of the ink chambers 15-1, 15-4, 15-7 corresponding to the respective nozzles 8-1, 8-4, 8-7 with nozzle Nos.i=1, 4, 7. Also, the driving device applies an ejection pulse signal (ejection drive signal for adjacent units on both sides) that changes in order of ground voltage VSS, positive voltage +VAA, ground voltage VSS, negative voltage −VAA, and ground voltage VSS, to the electrodes 4 of the ink chambers 15-0, 15-2, 15-3, 15-5, 15-6, 15-8 corresponding to the respective nozzles 8-0, 8-2, 8-3, 8-5, 8-6, 8-8 with nozzle Nos.i=0, 2, 3, 5, 6, 8. Thus, an ink drop is ejected from the nozzles 8-1, 8-4, 8-7.

FIG. 6 shows the case where an ink drop is ejected from the respective nozzles 8-1, 8-7 with nozzle Nos.i=1, 7, whereas an auxiliary operation to deform partitions 16-34, 16-45 to such an extent that an ink drop is not ejected is carried out in the ink chamber 15-4 communicating with the nozzle 8-4 with nozzle No.i=4 in the same group as nozzle Nos.i=1, 7. In this case, the respective ink chambers 15-0 to 15-8 change in order of stationary state, lead-in state, stationary state, first compressive state, second compressive state, and stationary state, according to one cycle of ejection pulse signal and auxiliary pulse signal.

In the stationary state, the driving device gives a ground voltage VSS to the electrodes 4 of the respective ink chambers 15-0 to 15-8. In the lead-in state, the driving device applies a negative voltage −VAA to each electrode 4 of the ink chambers 15-1 and 15-7 that are ink ejection targets, and applies a positive voltage +VAA to the electrodes 4 of the respective ink chambers 15-0, 15-2 and 15-6, 15-8 arranged adjacently on both sides of the ink chambers 15-1 and 15-7. With such control of the drive pulse voltage, the capacity of the ink chambers 15-1 and 15-7 is expanded.

Here, in the ink chamber 15-2 adjacent to the ink chamber 15-1, a partition 16-12 on the side of the ink chamber 15-1 is deformed and therefore an ink drop may be ejected erroneously. Thus, the driving device controls the drive pulse voltage in such a way that a partition 16-23 on the side of the ink chamber 15-3 is not deformed. That is, the driving device also applies a voltage of the same potential as the electrode 4 of the ink chamber 15-2, that is, a positive voltage +VAA, to the electrode 4 of the ink chamber 15-3. As the electrode 4 of the ink chamber 15-2 has the same potential as the electrode 4 of the ink chamber 15-3, the partition 16-23 between the ink chamber 15-2 and the ink chamber 15-3 is not deformed.

For the same reason, the driving device also applies a positive voltage +VAA to the electrode 4 of the ink chamber 15-5 adjacent to the ink chamber 15-6. As a result, the electrodes of the ink chambers 15-3, 15-5 arranged on both sides of the ink chamber 15-4, where the auxiliary operation is carried out, have a positive voltage +VAA. Thus, the driving device also applies a positive voltage +VAA to the electrode of the ink chamber 15-4 so that the partitions 16-34, 16-45 on both sides of the ink chamber 15-4 are not deformed.

In the first compressive state, the driving device applies a positive voltage +VAA to the electrodes 4 of the ink chambers 15-1 and 15-7 and applies a negative voltage −VAA to the electrodes 4 of the ink chambers 15-0, 15-2 and 15-6, 15-8 arranged adjacently on both sides of the ink chambers 15-1 and 15-7. Also, for the purpose of preventing the foregoing erroneous ejection, the driving device also applies a negative voltage −VAA to the electrodes 4 of the ink chamber 15-4, where the auxiliary operation is carried out, and the ink chambers 15-3, 15-5 adjacent to the ink chamber 15-4.

In the second compressive state, the driving device applies a positive voltage +VAA to the electrode 4 of the ink chamber 15-4, where the auxiliary operation is carried out. When the positive voltage +VAA is applied to the electrode 4 of the ink chamber 15-4, a potential difference is generated between the electrodes 4 arranged in the partitions 16-34, 16-45 on both sides of the ink chamber 15-4, thus deforming the two partitions 16-34, 16-45 in such a direction that the ink chamber 15-4 is compressed. This deformation causes preliminary vibration of the ink chamber 15-4. Alternatively, pressure vibration of the ink chamber 15-4 is absorbed.

That is, the driving device applies an ejection pulse signal (ejection drive signal for unit concerned) that changes in order of ground voltage VSS, negative voltage −VAA, ground voltage VSS, positive voltage +VAA, and ground voltage VSS, to the electrodes 4 of the ink chambers 15-1, 15-7 corresponding to the respective nozzles 8-1, 8-7 with nozzle Nos.i=1, 7. The driving device applies an ejection pulse signal (ejection drive signal for adjacent units on both sides) that changes in order of ground voltage VSS, positive voltage +VAA, ground voltage VSS, negative voltage −VAA, and ground voltage VSS, to the electrodes 4 of the ink chambers 15-0, 15-2, 15-6, 15-8 corresponding to the respective nozzles 8-0, 8-2, 8-6, 8-8 with nozzle Nos.i=0, 2, 6, 8. Thus, an ink drop is ejected from the nozzles 8-1, 8-7.

Meanwhile, the driving device applies auxiliary pulse signal (auxiliary drive signal for unit concerned) that changes in order of ground voltage VSS, positive voltage +VAA, ground voltage VSS, negative voltage −VAA, positive voltage +VAA, and ground voltage VSS, to the electrode 4 of the ink chamber 15-4 corresponding to the nozzle 8-4 with nozzle No.i=4. The driving device applies an auxiliary pulse signal (auxiliary drive signal for adjacent units on both sides) that changes in order of ground voltage VSS, positive voltage +VAA, ground voltage VSS, negative voltage −VAA, and ground voltage VSS, to the electrodes 4 of the ink chambers 15-3, 15-5 corresponding to the respective nozzles 8-3, 8-5 with nozzle Nos.i=3, 5. Thus, preliminary vibration of the ink chamber 15-4 communicating with the nozzle 8-4 occurs. Alternatively, pressure vibration of the ink chamber 15-4 is absorbed.

Figure 7:
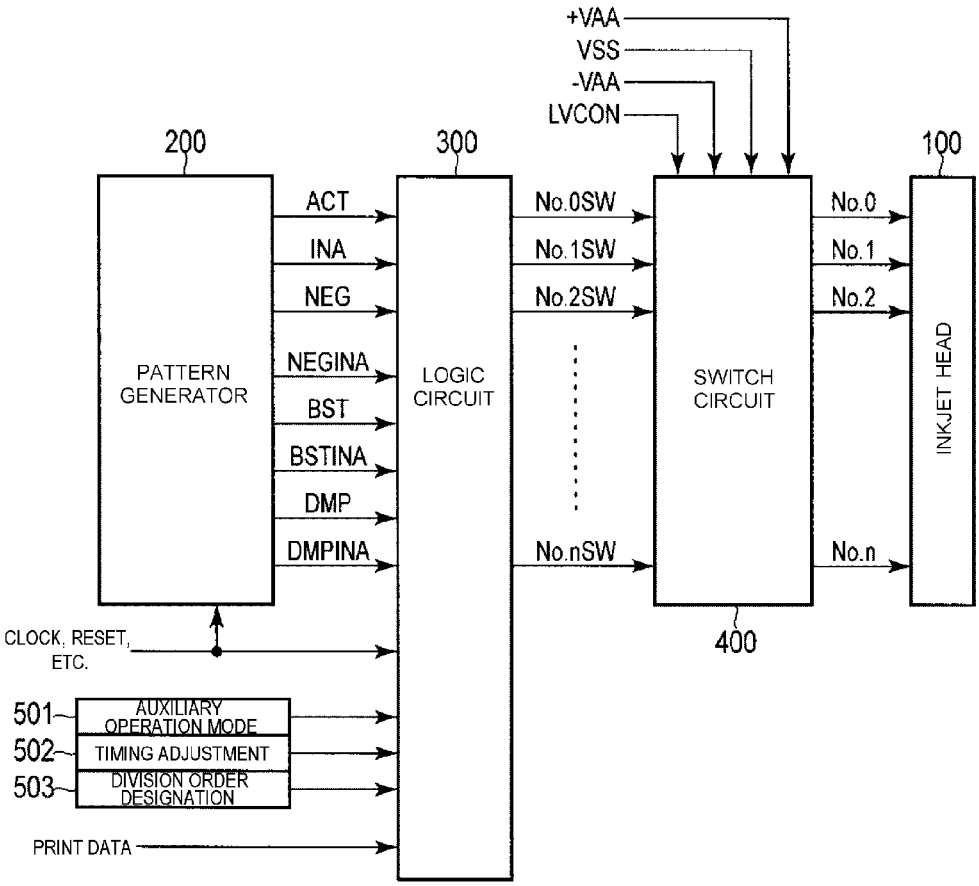
FIG. 7 is a block diagram showing the configuration of an inkjet head driving device.

FIG. 7 is a block diagram showing the configuration of the driving device of the embodiment. The driving device includes a pattern generator 200, a logic circuit 300, and a switch circuit 400. The driving device also includes an auxiliary operation mode setting register 501, a timing adjustment data setting register 502, and a division order designation data setting register 503.

The pattern generator 200 generates various drive signals and outputs the drive signals to the logic circuit 300. The logic circuit 300 generates a switch-specific control signal No.x SW based on the various drive signals and the respective setting registers 501, 502, 503, and outputs the control signal to the switch circuit 400.

Figure 8:
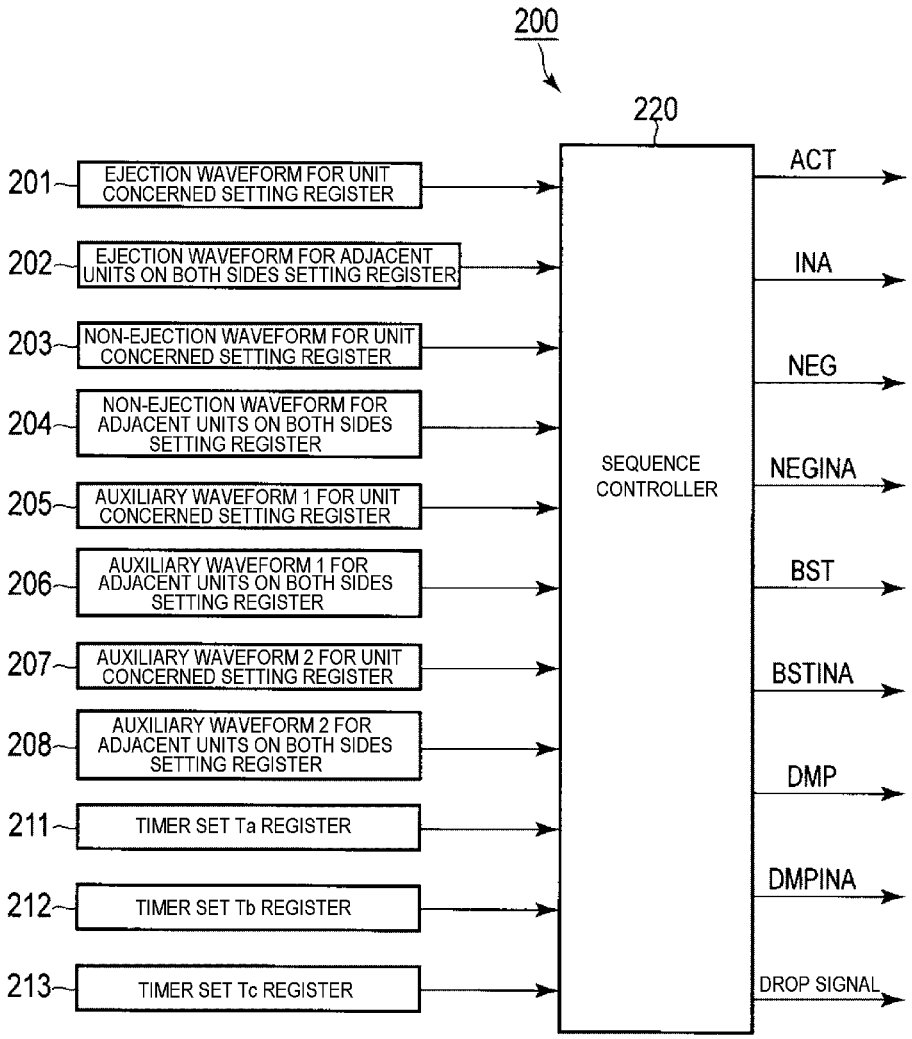
FIG. 8 is a block diagram showing the configuration of a pattern generator.

FIG. 8 is a block diagram showing the configuration of the pattern generator 200. The pattern generator 200 includes a register group and a sequence controller 220. The register group includes an ejection waveform for unit concerned setting register 201, an ejection waveform for adjacent units on both sides setting register 202, a non-ejection waveform for unit concerned setting register 203, a non-ejection waveform for adjacent units on both sides setting register 204, an auxiliary waveform 1 for unit concerned setting register 205, an auxiliary waveform 1 for adjacent units on both sides setting register 206, an auxiliary waveform 2 for unit concerned setting register 207, an auxiliary waveform 2 for adjacent units on both sides setting register 208, a timer set Ta register 211, a timer set Tb register 212, and a timer set Tc register 213.

In the ejection waveform for unit concerned setting register 201, the electric potential of the drive pulse applied to the electrode 4 of the ink chamber 15 communicating with the nozzle 8 that ejects an ink drop in division driving (hereinafter referred to as an ejection nozzle concerned 8*a*) is set in time series. In the ejection waveform for adjacent units on both sides setting register 202, the electric potential of the drive pulse applied to the electrodes 4 of the ink chambers 15 communicating with the adjacent nozzles 8 on both sides of the ejection nozzle concerned 8*a* (hereinafter referred to as ejection adjacent nozzles 8*b*) is set in time series.

In the non-ejection waveform for unit concerned setting register 203, the electric potential of the drive pulse applied to the electrode 4 of the ink chamber 15 communicating with the nozzle 8 that does not eject an ink drop in division driving (hereinafter referred to as a non-ejection nozzle concerned 8*c*) is set in time series. In the non-ejection waveform for adjacent units on both sides setting register 204, the electric potential of the drive pulse applied to the electrodes 4 of the ink chambers 15 communicating with the adjacent nozzles 8 on both sides of the non-ejection nozzle concerned 8*c* (hereinafter referred to as non-ejection adjacent nozzles 8*d*) is set in time series.

In the auxiliary waveform 1 for unit concerned setting register 205, the electric potential of the drive pulse applied to the electrode 4 of the ink chamber 15 communicating with the nozzle 8 where a first auxiliary operation is carried out in division driving (hereinafter referred to as an auxiliary nozzle concerned 1 8*e*) is set in time series. In the auxiliary waveform 1 for adjacent units on both sides setting register 206, the electric potential of the drive pulse applied to the electrodes 4 of the ink chambers 15 communicating with the adjacent nozzles 8 on both sides of the auxiliary nozzle concerned 1 8*e* (hereinafter referred to as auxiliary adjacent nozzles 1 8*f*) is set in time series.

In the auxiliary waveform 2 for unit concerned setting register 207, the electric potential of the drive pulse applied to the electrode 4 of the ink chamber 15 communicating with the nozzle 8 where a second auxiliary operation is carried out in division driving (hereinafter referred to as an auxiliary nozzle concerned 2 8*g*) is set in time series. In the auxiliary waveform 2 for adjacent units on both sides setting register 208, the electric potential of the drive pulse applied to the electrodes 4 of the ink chambers 15 communicating with the adjacent nozzles 8 on both sides of the auxiliary nozzle concerned 2 8*g* (hereinafter referred to as auxiliary adjacent nozzles 2 8*h*) is set in time series.

The first auxiliary operation is an operation in which a drive pulse is applied to the actuator before an ejection pulse signal in order to cause preliminary vibration of the ink chamber where a partition is deformed in response to the ejection pulse signal. The second auxiliary operation is an operation in which a drive pulse is applied to the actuator after an ejection pulse signal in order to absorb pressure vibration of the ink chamber from which an ink drop is ejected in response to the ejection pulse signal.

In the timer set Ta register 211, the holding time of each electric potential set in the auxiliary waveform 1 for unit concerned setting register 205 and the auxiliary waveform 1 for adjacent units on both sides setting register 206 (hereinafter referred to as a timer set Ta) is set in time series. In the timer set Tb register 212, the holding time of each electric potential set in the ejection waveform for unit concerned setting register 201 and the ejection waveform for adjacent units on both sides setting register 202 (hereinafter referred to as a timer set Tb) is set in time series. In the timer set Tc register 213, the holding time of each electric potential set in the auxiliary waveform 2 for unit concerned setting register 207 and the auxiliary waveform 2 for adjacent units on both sides setting register 208 (timer set Tc) is set in time series.

Here, the timer set Ta register 211, the timer set Tb register 212 and the timer set Tc register 213 form a storage unit.

The sequence controller 220 generates a pulse waveform formed by holding the electric potential sequentially read out from the ejection waveform for unit concerned setting register 201 for the holding time of the timer set Tb sequentially read out from the timer set Tb register 212. The sequence controller 220 outputs a signal of this pulse waveform to the logic circuit 300 as an ejection drive signal for unit concerned (ACT).

The sequence controller 220 generates a pulse waveform formed by holding the electric potential sequentially read out from the ejection waveform for adjacent units on both sides setting register 202 for the holding time of the timer set Tb sequentially read out from the timer set Tb register 212. The sequence controller 220 outputs a signal of this pulse waveform to the logic circuit 300 as an ejection drive signal for adjacent units on both sides (INA).

The sequence controller 220 generates a pulse waveform formed by holding the electric potential sequentially read out from the non-ejection waveform for unit concerned setting register 203 for the holding time of the timer set Ta, Tb or Tc sequentially read out from one of the timer set registers 211 to 213. The sequence controller 220 outputs a signal of this pulse waveform to the logic circuit 300 as a non-ejection drive signal for unit concerned (NEG).

The sequence controller 220 generates a pulse waveform formed by holding the electric potential sequentially read out from the non-ejection waveform for adjacent units on both sides setting register 204 for the holding time of the timer set Ta, Tb or Tc sequentially read out from one of the timer set registers 211 to 213. The sequence controller 220 outputs a signal of this pulse waveform to the logic circuit 300 as a non-ejection drive signal for adjacent units on both sides (NEGINA).

The sequence controller 220 generates a pulse waveform formed by holding the electric potential sequentially read out from the auxiliary waveform 1 for unit concerned setting register 205 for the holding time of the timer set Ta sequentially read out from the timer set Ta register 211. The sequence controller 220 outputs a signal of this pulse waveform to the logic circuit 300 as an auxiliary drive signal 1 for unit concerned (BST).

The sequence controller 220 generates a pulse waveform formed by holding the electric potential sequentially read out from the auxiliary waveform 1 for adjacent units on both sides setting register 206 for the holding time of the timer set Ta sequentially read out from the timer set Ta register 211. The sequence controller 220 outputs a signal of this pulse waveform to the logic circuit 300 as an auxiliary drive signal 1 for adjacent units on both sides (BSTINA).

The sequence controller 220 generates a pulse waveform formed by holding the electric potential sequentially read out from the auxiliary waveform 2 for unit concerned setting register 207 for the holding time of the timer set Tc sequentially read out from the timer set Tc register 213. The sequence controller 220 outputs a signal of this pulse waveform to the logic circuit 300 as an auxiliary drive signal 2 for unit concerned (DMP).

The sequence controller 220 generates a pulse waveform formed by holding the electric potential sequentially read out from the auxiliary waveform 2 for adjacent units on both sides setting register 208 for the holding time of the timer set Tc sequentially read out from the timer set Tc register 213. The sequence controller 220 outputs a signal of this pulse waveform to the logic circuit 300 as an auxiliary drive signal 2 for adjacent units on both sides (DMPINA).

The sequence controller 220 outputs a drop signal to the logic circuit 300 every time the entire holding time of the timer set Ta, Tb or Tc sequentially read out from the timer set Ta register 211, the timer set Tb register 212 or the timer set Tc register 213 ends.

Figure 9:
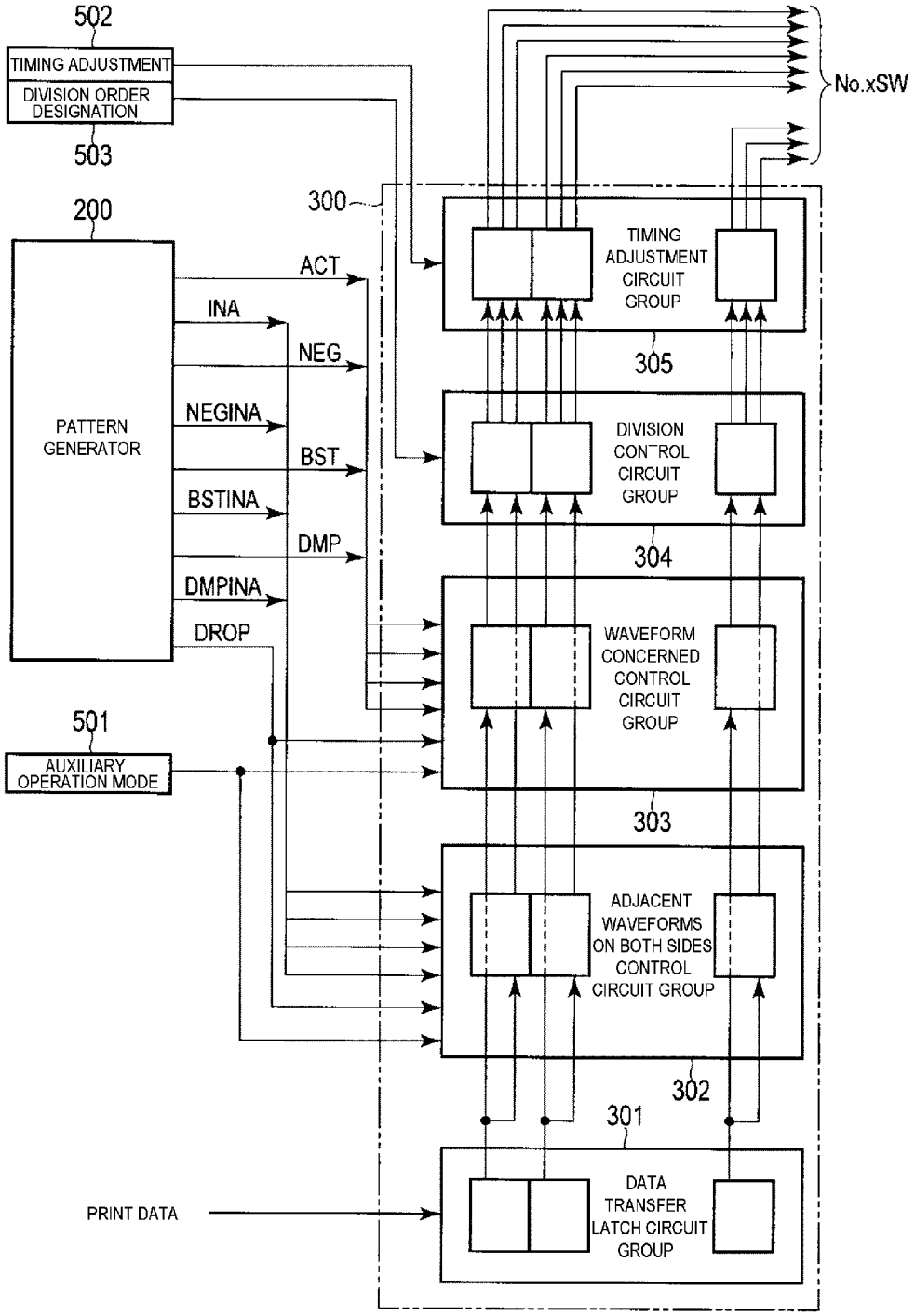
FIG. 9 is a block diagram showing the configuration of a logic circuit.

FIG. 9 is a block diagram showing the configuration of the logic circuit 300. The logic circuit 300 has a data transfer latch circuit 301, an adjacent waveforms on both sides control circuit 302, a waveform concerned control circuit 303, a division control circuit 304, and a timing adjustment circuit 305, for each set made up of three neighboring nozzles in the head 100. That is, the logic circuit 300 has a group of data transfer latch circuits 301, a group of adjacent waveforms on both sides control circuit 302, a group of waveform concerned control circuits 303, a group of division control circuit 304, and a group of timing adjustment circuit 305, corresponding to each set of nozzles.

Each data transfer latch circuit 301 sequentially transfers, between the circuits, print data supplied from an external device, and latches one line data of the head 100.

Each adjacent waveforms on both sides control circuit 302 respectively takes in the ejection drive signal for adjacent units on both sides (INA), the non-ejection drive signal for adjacent units on both sides (NEGINA), the auxiliary drive signal 1 for adjacent units on both sides (BSTINA), the auxiliary drive signal 2 for adjacent units on both sides (DMPINA) and the drop signal from the pattern generator 200. Also, each adjacent waveforms on both sides control circuit 302 respectively takes in the data of the auxiliary operation mode from the setting register 501. The auxiliary operation mode will be described later. Each adjacent waveforms on both sides control circuit 302 counts the drop signal, respectively. Then, each adjacent waveforms on both sides control circuit 302 selects one of the ejection drive signal for adjacent units on both sides (INA), the non-ejection drive signal for adjacent units on both sides (NEGINA), the auxiliary drive signal 1 for adjacent units on both sides (BSTINA), and the auxiliary drive signal 2 for adjacent units on both sides (DMPINA), based on the count value of the drop signal and the data latched by the corresponding data transfer latch circuit 301, and outputs the selected signal to the corresponding division control circuit 304.

Each waveform concerned control circuit 303 respectively takes in the ejection drive signal for unit concerned (ACT), the non-ejection drive signal for unit concerned (NEG), the auxiliary drive signal 1 for unit concerned (BST), the auxiliary drive signal 2 for unit concerned (DMP), and the drop signal from the pattern generator 200. Also, each waveform concerned control circuit 303 respectively takes in the data of the auxiliary operation mode from the setting register 501. Each waveform concerned control circuit 303 respectively counts the drop signal. Then, each waveform concerned control circuit 303 selects one of the ejection drive signal for unit concerned (ACT), the non-ejection drive signal for unit concerned (NEG), the auxiliary drive signal 1 for unit concerned (BST), and the auxiliary drive signal 2 for unit concerned (DMP), based on the count value of the drop signal and the data latched by the corresponding data transfer latch circuit 301, and outputs the selected signal to the corresponding division control circuit 304.

Each division control circuit 304 respectively takes in the division order designation data from the setting register 503. Then, each division control circuit 304 outputs signals provided from the adjacent waveforms on both sides control circuit 302 and the waveform concerned control circuit 303 to the corresponding timing adjustment circuit 305 according to the order designated by the division order designation data.

Each timing adjustment circuit 305 respectively takes in the timing adjustment data from the setting register 502. Then, each timing adjustment circuit 305 adjusts the output timing of the signal provided from the division control circuit 304, according to the timing adjustment data, and outputs the adjusted output timing to the switch circuit 400 as a control signal No.x SW.

Here, the pattern generator 200 and the logic circuit 300 form an ejection pulse application unit that applies the ejection pulse signals (ejection drive signal for unit concerned and ejection drive signal for adjacent units on both sides) to the inkjet head 100 and an auxiliary pulse application unit that applies the auxiliary pulse signals (auxiliary drive signal for unit concerned and auxiliary drive signal for adjacent units on both sides) to the inkjet head 100.

The switch circuit 400 has (n+1) control switches SWx (x=0 to n) corresponding to all the nozzles 8-0 to 8-n with nozzle Nos.i=0 to n (n≥1) in the head 100. This switch circuit 400 is supplied with a positive voltage +VAA, a negative voltage −VAA, a ground voltage VSS and a common voltage LVCON from a power supply circuit, not shown. Also, a control signal No.x SW (x=0 to n) specific to each control switch SWx is inputted to the switch circuit 400 from the logic circuit 300. The common voltage LVCON is selected from the positive voltage +VAA, the negative voltage −VAA and the ground voltage VSS and commonly applied to all the control switches SWx.

Figure 10:
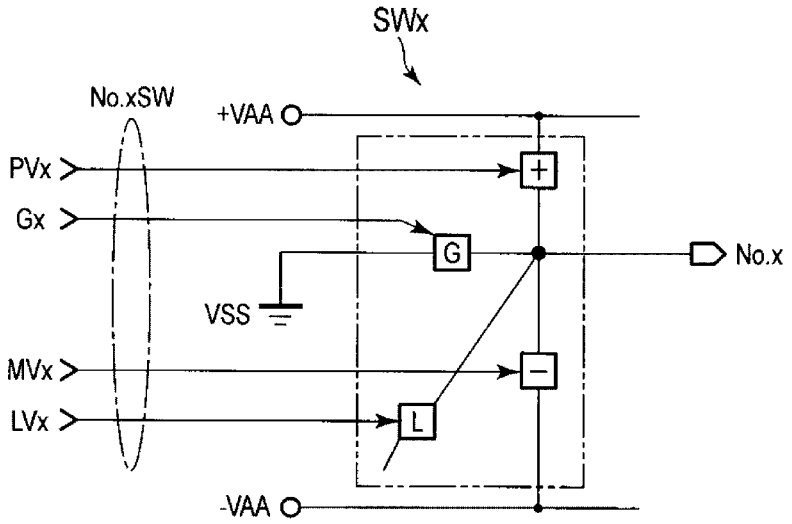
FIG. 10 is a schematic view showing an example of a control switch provided in a switch circuit.

FIG. 10 is a circuit diagram of the control switch SWx. The control switch SWx connects each output terminal of a positive voltage contact [+], a negative voltage contact [−], a ground contact [G] and a common voltage contact [L] to the output terminal No.x of the head 100. The input terminal of the positive voltage contact [+] is connected to the terminal of the positive voltage +VAA. The input terminal of the negative voltage contact [−] is connected to the terminal of the negative voltage −VAA. The input terminal of the ground contact [G] is connected to the terminal of the ground voltage VSS. The input terminal of the common voltage contact [L] is connected to the terminal of the common voltage LVCON (not shown).

The positive voltage contact [+] connects the input terminal and the output terminal to each other while a positive voltage signal PVx is on. As a result, the positive voltage +VAA is applied to the nozzle 8-x corresponding to the control switch SWx. The negative voltage contact [−] connects the input terminal and the output terminal to each other while a negative voltage signal MVx is on. As a result, the negative voltage −VAA is applied to the nozzle 8-x corresponding to the control switch SWx. The ground contact [G] connects the input terminal and the output terminal to each other while a ground signal Gx is on. As a result, the ground voltage VSS is applied to the nozzle 8-x corresponding to the control switch SWx. The common voltage contact [L] connects the input terminal and the output terminal to each other while a common voltage signal LVx is on. As a result, the common voltage LVCON is applied to the nozzle 8-x corresponding to the control switch SWx. The positive voltage signal PVx, the negative voltage signal MVx, the ground signal Gx and the common voltage signal LVx are included in the control signal No.x SW inputted from the logic circuit 300.

Next, the auxiliary operation mode will be described with reference to FIGS. 11 and 12.

As described above, the auxiliary operation includes the first auxiliary operation aimed at causing preliminary vibration of the ink chamber where a partition is deformed in response to an ejection drive signal for unit concerned (ACT), and the second auxiliary operation aimed at absorbing pressure vibration of the ink chamber from which an ink drop is ejected in response to an ejection drive signal for unit concerned (ACT). In the case of the first auxiliary operation, the driving device applies an auxiliary drive signal 1 for unit concerned (BST) before the ejection drive signal for unit concerned (ACT). In the case of the second auxiliary operation, the driving device applies an auxiliary drive signal 2 for unit concerned (DMP) after the ejection drive signal for unit concerned (ACT).

Meanwhile, in the multi-drop drive system, the gradation of a pixel is expressed by the number of ink drops. Therefore, the driving device outputs an ejection drive signal for unit concerned (ACT) for one cycle to a nozzle that prints a single-tone pixel and outputs an ejection drive signal for unit concerned (ACT) for two cycles to a nozzle that prints a two-tone pixel. Similarly, for example, the driving device outputs an ejection drive signal for unit concerned (ACT) for 15 cycles to a nozzle that prints a 15-tone pixel.

In FIG. 11, a full-boost advance reference mode M1 is a mode in which an auxiliary drive signal 1 for unit concerned (BST) is added before the leading ejection drive signal for unit concerned (ACT) when the ejection drive signal for unit concerned (ACT) to each pixel from single-tone (1h) to 15-tone (Fh) is aligned based on an advance reference.

A full-boost after-reference mode M2 is a mode in which an auxiliary drive signal 1 for unit concerned (BST) is added before the leading ejection drive signal for unit concerned (ACT) when the ejection drive signal for unit concerned (ACT) to each pixel from single-tone (1h) to 15-tone (Fh) is aligned based on an after-reference.

A full-dump advance reference mode M3 is a mode in which an auxiliary drive signal 2 for unit concerned (DMP) is added after the final ejection drive signal for unit concerned (ACT) when the ejection drive signal for unit concerned (ACT) to each pixel from a single tone (1h) to 15 tones (Fh) is aligned based on an advance reference.

A full-dump after-reference mode M4 is a mode in which an auxiliary drive signal 2 for unit concerned (DMP) is added after the final ejection drive signal for unit concerned (ACT) when the ejection drive signal for unit concerned (ACT) to each pixel from a single tone (1h) to 15 tones (Fh) is aligned based on an after-reference.

As can be seen in FIG. 11, in the full-boost after-reference mode M2, in some cases, the auxiliary drive signal 1 for unit concerned (BST) may be outputted in the same waveform frame as the ejection drive signal for unit concerned (ACT), depending on the number of tones of the pixel. Also, in the full-dump advance reference mode M3, in some cases, the auxiliary drive signal 2 for unit concerned (DMP) may be outputted in the same waveform frame as the ejection drive signal for unit concerned (ACT), depending on the number of tones of the pixel data.

Here, the waveform frame refers to the time required to output various drive signals for one cycle. This time is constant irrespective of the type of drive signal. Therefore, since the auxiliary drive signal 1 for unit concerned (BST) may be outputted in the same waveform frame as the ejection drive signal for unit concerned (ACT), the auxiliary drive signal 1 for unit concerned (BST) must take the influence of the ejection drive signal for unit concerned (ACT) into consideration. Similarly, the auxiliary drive signal 2 for unit concerned (DMP), too, must take the influence of the ejection drive signal for unit concerned (ACT) into consideration.

Thus, in this embodiment, the full-boost advance reference mode M1 and the full-dump after-reference mode M4 are used as auxiliary operation modes, as shown in FIG. 12. That is, data to select the full-boost advance reference mode M1 or data to select the full-dump after-reference mode M4 is set in the setting register 501.

If data to select the full-boost advance reference mode M1 is set in the setting register 501, the driving device outputs an auxiliary drive signal 1 for unit concerned (BST) to each nozzle of ink ejection targets before the leading ejection drive signal for unit concerned (ACT), irrespective of the gradation of the pixel, and thus causes preliminary vibration of the ink chamber communicating with each nozzle. Here, at the timing when the auxiliary drive signal 1 for unit concerned (BST) is outputted, the ejection drive signal for unit concerned (ACT) is not outputted to any nozzle. Therefore, the auxiliary drive signal 1 for unit concerned (BST) need not take the influence of the ejection drive signal for unit concerned (ACT) into consideration.

Similarly, if data to select the full-dump after-reference mode M4 is set in the setting register 501, the driving device outputs an auxiliary drive signal 2 for unit concerned (DMP) to each nozzle of ink ejection targets after the last ejection drive signal for unit concerned (ACT), irrespective of the gradation of the pixel, and thus absorbs pressure vibration of the ink chamber communicating with each nozzle. Here, at the timing when the auxiliary drive signal 2 for unit concerned (DMP) is outputted, the ejection drive signal for unit concerned (ACT) is not outputted to any nozzle. Therefore, the auxiliary drive signal 2 for unit concerned (DMP) need not take the influence of the ejection drive signal for unit concerned (ACT) into consideration.

Since the auxiliary drive signal 1 for unit concerned (BST) and the auxiliary drive signal 2 for unit concerned (DMP) are not influenced by the ejection drive signal for unit concerned (ACT), the holding time (timer set) for each electric potential in one cycle can be set arbitrarily. That is, the degree of freedom in setting a timer set for the auxiliary drive signal 1 for unit concerned (BST) and the auxiliary drive signal 2 for unit concerned (DMP) is improved.

In this embodiment, the timer set Tb set in the timer set Tb register 212 is used as the value of a timer set at the time of generating the ejection drive signal for unit concerned (ACT), as shown in FIG. 12. On the other hand, the timer set Ta set in the timer set Ta register 211 is used as the value of a timer set at the time of generating the auxiliary drive signal 1 for unit concerned (BST). Also, the timer set Tc set in the timer set Tc register 213 is used as the value of a timer set at the time of generating the auxiliary drive signal 2 for unit concerned (DMP). Which timer set is to be used for each signal is set in the sequence controller 220.

Here, the pattern generator 200 and the logic circuit 300 form a control unit that causes the an ejection pulse signal and an auxiliary pulse signal to be applied to the inkjet head 100 at different timings so that the ejection pulse signal and the auxiliary pulse signal are not applied simultaneously. At the timing to apply en ejection pulse signal, the control unit generates an ejection pulse signal using first timer set data (timer set Tb) and causes the ejection pulse signal to be applied to the inkjet head 100. At the timing to apply an auxiliary pulse signal, the control unit generates an auxiliary pulse signal using second timer set data (timer set Ta or timer set Tc) and causes the auxiliary pulse signal to be applied to the inkjet head 100.

Next, the effect of differentiating the timer set Tb for the ejection drive signal for unit concerned (ACT) and the timer set Ta for the auxiliary drive signal 1 for unit concerned (BST)

will be described with reference to FIGS. 13 to 16. The effect of differentiating the timer set Tb for the ejection drive signal for unit concerned (ACT) and the timer set Tc for the auxiliary drive signal 2 for unit concerned (DMP) is the same and therefore will not be described further in detail here.

FIG. 13 shows a specific example of a drive signal outputted to the respective nozzles 8-0 to 8-8 with nozzle Nos.i=0 to 8 within a period of waveform frames W0 to W7 in three-division drive control in which an ink drop is ejected from the respective nozzles 8-1, 8-4, 8-7 with nozzle Nos.i=1, 4, 7. In this example, the full-boost advance reference mode is set. Also, in this case, the gradation of the pixel expressed by the ink drop ejected from the nozzle 8-4 with nozzle No.i=4 is "3", and the gradation of the pixel expressed by the ink drop ejected from the nozzle 8-7 with nozzle No.i=7 is "7". The nozzle 8-1 with nozzle No.i=1 does not eject any ink drop.

In this case, in the leading waveform frame W0, a non-ejection drive signal for unit concerned (NEG) is outputted to the nozzle 8-1, and a non-ejection drive signal for adjacent units on both sides (NEGINA) is outputted to the adjacent nozzles 8-0, 8-2 on both sides of the nozzle 8-1. An auxiliary drive signal 1 for unit concerned (BST) is outputted to the nozzles 8-4 and 8-7, and an auxiliary drive signal 1 for adjacent units on both sides (BSTINA) is outputted to the adjacent nozzles 8-3, 8-5 and 8-6, 8-8 on both sides of the nozzles 8-4 and 8-7.

In the next waveform frame W1, a non-ejection drive signal for unit concerned (NEG) is outputted to the nozzle 8-1, and a non-ejection drive signal for adjacent units on both sides (NEGINA) is outputted to the adjacent nozzles 8-0, 8-2 on both sides of the nozzle 8-1. An ejection drive signal for unit concerned (ACT) is outputted to the nozzles 8-4 and 8-7, and an ejection drive signal for adjacent units on both sides (INA) is outputted to the adjacent nozzles 8-3, 8-5 and 8-6, 8-8 on both sides of the nozzles 8-4 and 8-7.

Meanwhile, for example, in the waveform frame W4, a non-ejection drive signal for unit concerned (NEG) is outputted to the nozzles 8-1, 8-4 and a non-ejection drive signal for adjacent units on both sides (NEGINA) is outputted to the adjacent nozzles 8-0, 8-2 and 8-3, 8-5 on both sides of the nozzles 8-1, 8-4. An ejection drive signal for unit concerned (ACT) is outputted to the nozzle 8-7, and an ejection drive signal for adjacent units on both sides (INA) is outputted to the adjacent nozzles 8-6, 8-8 on both sides of the nozzle 8-7.

Figure 14:
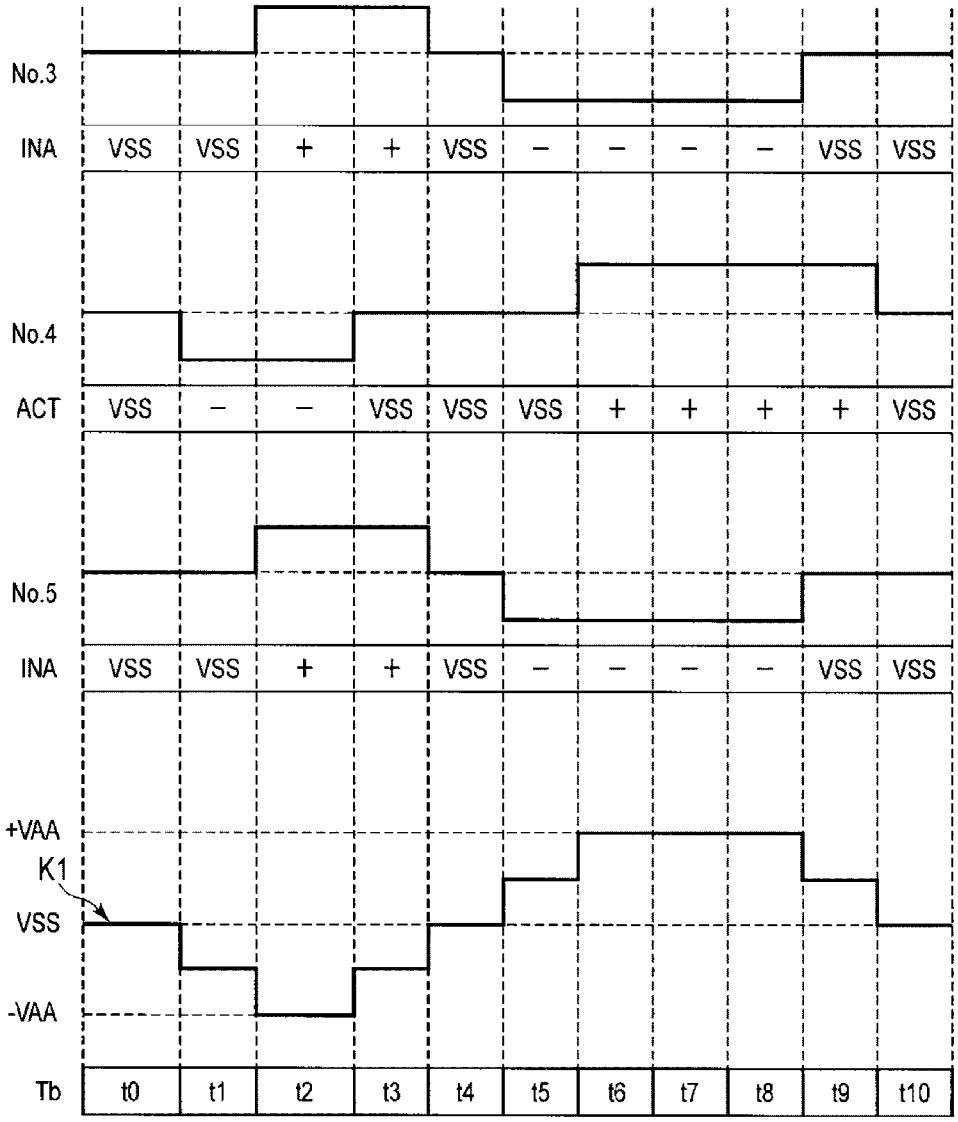
FIG. 14 is a view showing the waveform of an ejection drive signal for unit concerned and an ejection drive signal for adjacent units on both sides.

FIG. 14 shows the respective waveforms of the ejection drive signal for unit concerned (ACT) outputted to the nozzle 8-4 and the ejection drive signal for adjacent units on both sides (INA) outputted to the adjacent nozzles 8-3, 8-5 on both sides of the nozzle 8-4 in the section of the waveform frame W1. FIG. 14 also shows a mutual voltage waveform K1 between the first actuator and the second actuator for the ink chamber communicating with the nozzle 8-4. As such a shift of the voltage waveform K1 occurs between the first actuator and the second actuator, an ink drop is ejected from the nozzle 8-4.

By the way, if timer sets other than the timer set Tb are used, the mutual voltage waveform between the first actuator and the second actuator for the ink chamber communicating with the nozzle 8-4 changes. Therefore, an ink drop may not be ejected from the nozzle 8-4. In other words, in a waveform frame where the ejection drive signal for unit concerned (ACT) is outputted, there is no other choice than to use the timer set Tb.

Figure 15:
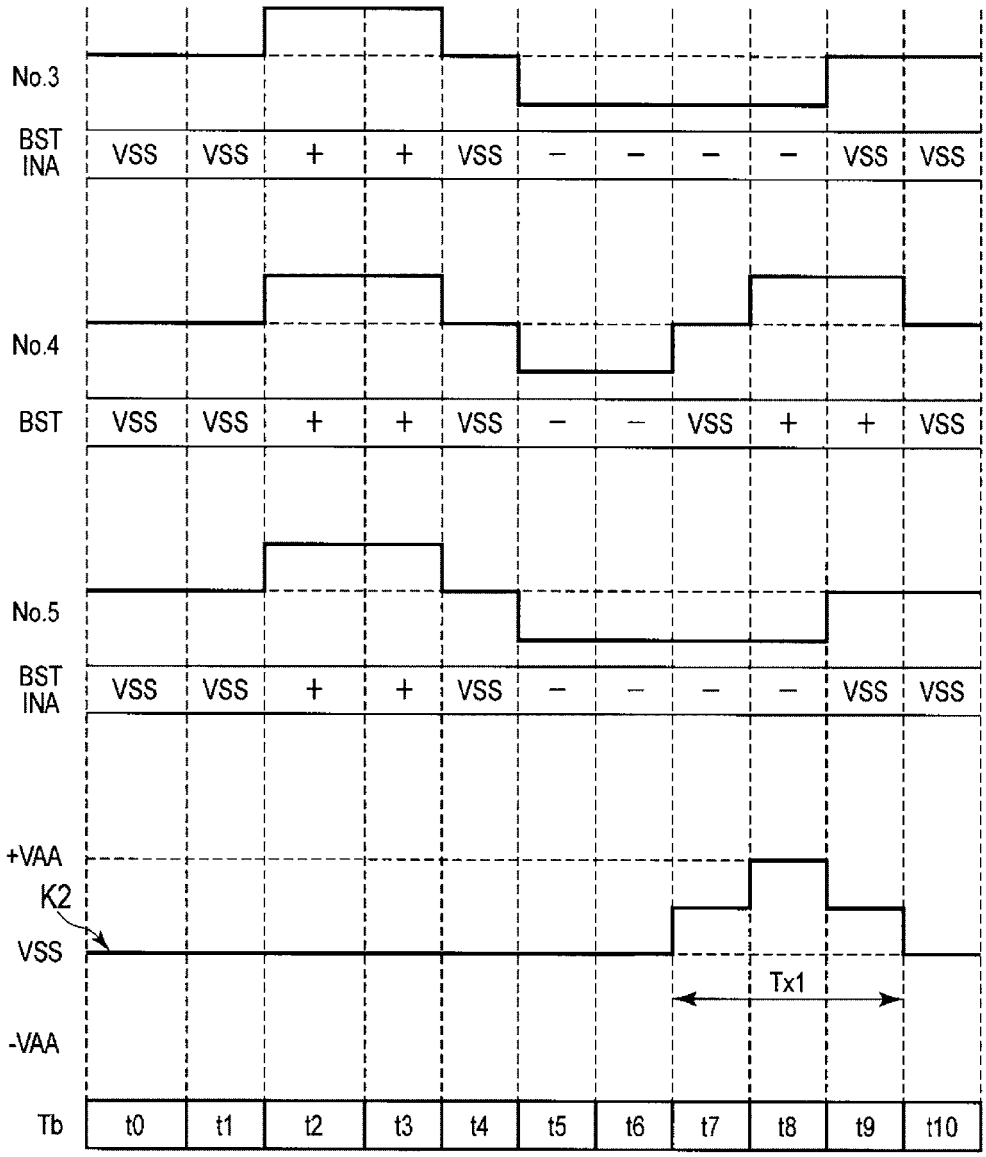
FIG. 15 is a view showing the waveform of an auxiliary drive signal for unit concerned and an auxiliary drive signal for adjacent units on both sides.

FIG. 15 shows the respective waveforms of the auxiliary drive signal 1 for unit concerned (BST) outputted to the nozzle 8-4 and the auxiliary drive signal 1 for adjacent units on both sides (BSTINA) outputted to the adjacent nozzles 8-3, 8-5 on both sides of the nozzle 8-4 at the timing of the waveform frame W0. FIG. 15 also shows a mutual voltage waveform K2 between the first actuator and the second actuator for the ink chamber communicating with the nozzle 8-4. However, in this case, each electric potential is held by the timer set Tb. In this case, the time for action to cause preliminary vibration of the ink chamber is a time range Tx1. With this time range Tx1, sufficient preliminary vibration cannot be provided for the ink chamber.

Figure 16:
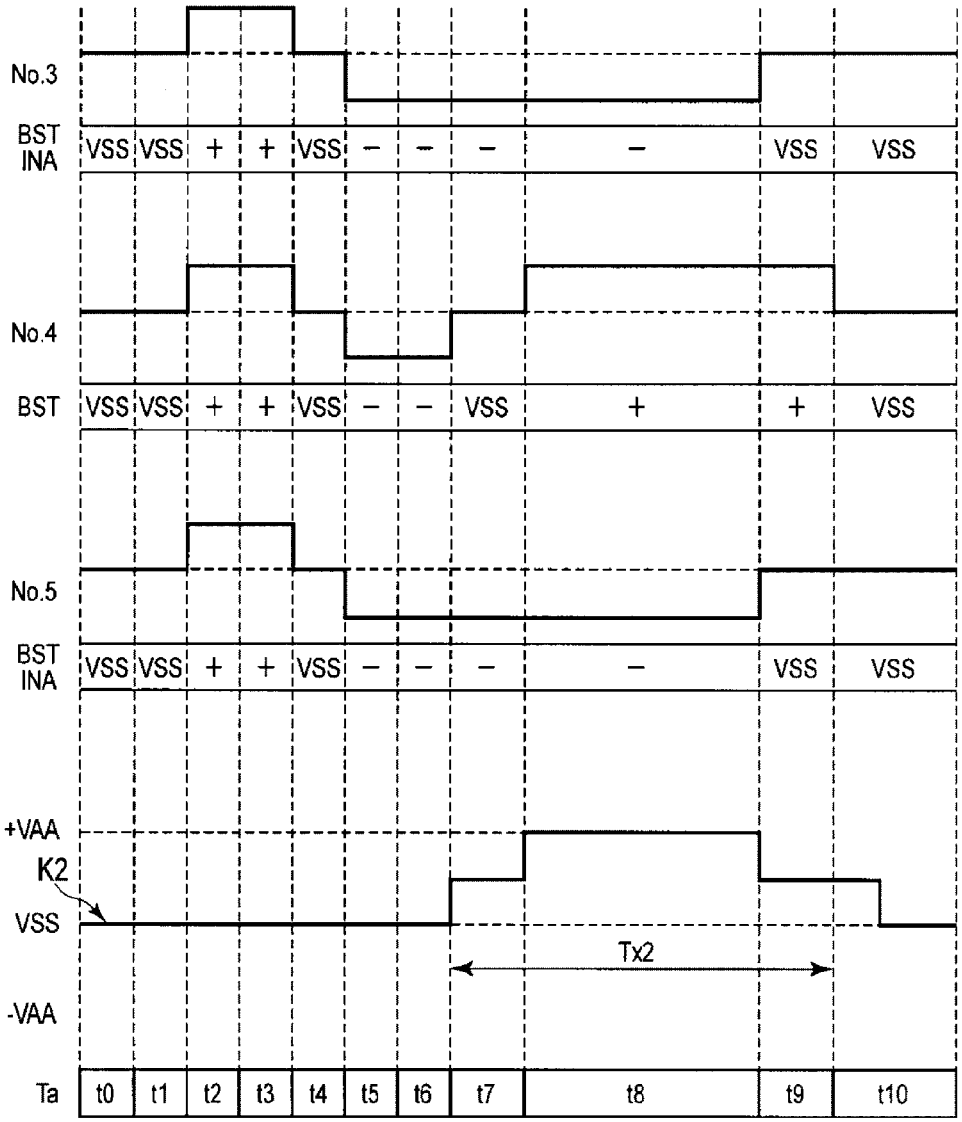
FIG. 16 is a view showing the waveform when the timer set used is changed, with respect to the signal waveform of FIG. 15.

FIG. 16 shows the case where each electric potential is held by the timer set Ta with respect to the same signals as FIG. 15. According to the timer set Ta, the holding time in the sections t0 to t6 is made shorter than in the same sections t0 to t6 in the timer set Tb, and the time of the sections t7 to t10 is made sufficiently longer. As a result, the time for causing preliminary vibration of the ink chamber is extended to a time range Tx2.

In this way, the embodiment has an effect that the constraint on the output of the auxiliary drive signal 1 for unit concerned (BST) or the auxiliary drive signal 2 for unit concerned (DMP) can be significantly relaxed.

The invention is not limited to the foregoing embodiment.

For example, while the auxiliary drive signal 1 for unit concerned (BST) applied to the inkjet head before an ejection pulse signal in order to cause preliminary vibration of the ink chamber where a partition is deformed in response to the ejection pulse signal and the auxiliary drive signal 2 for unit concerned (DMP) applied to the inkjet head after an ejection pulse signal in order to absorb pressure vibration of the ink chamber from which an ink drop is ejected in response to the ejection pulse signal are described as an example of an auxiliary pulse signal in the foregoing embodiment, the type of auxiliary pulse signal is not limited to these.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. A driving device for an inkjet head in which an electrode is arranged on a wall surface of each of plural ink chambers provided parallel to each other and separated from each other by a partition made of a piezoelectric material, a potential difference is provided between the electrodes of two adjacent ink chambers, the partition between the electrodes is thus deformed, and one to plural ink drops are ejected from a nozzle communicating with the ink chamber including the deformed partition as a wall surface thereof, thus forming a pixel, the device comprising:

an ejection pulse application unit configured to apply an ejection pulse signal which deforms a partition in such a way that an ink drop is ejected from the nozzle, as a drive signal for providing a potential difference between the electrodes, to the inkjet head;

an auxiliary pulse application unit configured to apply an auxiliary pulse signal which deforms the partition to such an extent that an ink drop is not ejected from the nozzle, as a drive signal for providing a potential difference between electrodes, to the inkjet head; and a control unit configured to cause the ejection pulse signal and the auxiliary pulse signal to be applied to the inkjet head at different timings so that the ejection pulse signal and the auxiliary pulse signal are not applied simultaneously.

2. The device according to claim 1, further comprising a storage unit configured to store first timer set data which sets, in time series, a time for holding each potential state of a drive waveform forming the ejection pulse signal, and second timer set data which sets, in time series, a time for holding each potential state of a drive waveform forming the auxiliary pulse signal, wherein at a timing to apply the ejection pulse signal, the control unit generates the ejection pulse signal using the first timer set data and causes the ejection pulse signal to be applied to the inkjet head, whereas at a timing to apply the auxiliary pulse signal, the control unit generates the auxiliary pulse signal using the second timer set data and causes the auxiliary pulse signal to be applied to the inkjet head.

3. The device according to claim 2, wherein the control unit causes the auxiliary pulse signal to be applied to the inkjet head before the ejection pulse signal in order to cause preliminary vibration of the ink chamber where the partition is deformed in response to the ejection pulse signal.

4. The device according to claim 2, wherein the control unit causes the auxiliary pulse signal to be applied to the inkjet head after the ejection pulse signal in order to absorb pressure vibration of the ink chamber from which an ink drop is ejected in response to the ejection pulse signal.

5. The device according to claim 1, wherein the control unit causes the auxiliary pulse signal to be applied to the inkjet head before the ejection pulse signal in order to cause preliminary vibration of the ink chamber where the partition is deformed in response to the ejection pulse signal.

6. The device according to claim 1, wherein the control unit causes the auxiliary pulse signal to be applied to the inkjet head after the ejection pulse signal in order to absorb pressure vibration of the ink chamber from which an ink drop is ejected in response to the ejection pulse signal.

7. A driving method for an inkjet head in which an electrode is arranged on a wall surface of each of plural ink chambers provided parallel to each other and separated from each other by a partition made of a piezoelectric material, a potential difference is provided between the electrodes of two adjacent ink chambers, the partition between the electrodes is thus deformed, and one to plural ink drops are ejected from a nozzle communicating with the ink chamber including the deformed partition as a wall surface thereof, thus forming a pixel, the method comprising:

applying an ejection pulse signal that deforms the partition in such a way that an ink drop is ejected from the nozzle and an auxiliary pulse signal that deforms the partition to such an extent that an ink drop is not ejected from the nozzle, as a drive signal for providing a potential difference between the electrodes, to the inkjet head at different timings so that the two pulse signals are not applied simultaneously, and thereby driving the inkjet head.

8. The method according to claim 7, wherein first timer set data that sets, in time series, a time for holding each potential state of a drive waveform forming the ejection pulse signal, and second timer set data that sets, in time series, a time for holding each potential state of a drive waveform forming the auxiliary pulse signal are provided, and at a timing to apply the ejection pulse signal, the ejection pulse signal is generated using the first timer set data and is applied to the inkjet head, whereas at a timing to apply the auxiliary pulse signal, the auxiliary pulse signal is generated using the second timer set data and is applied to the inkjet head.

9. The method according to claim 8, wherein the auxiliary pulse signal is applied to the inkjet head before the ejection pulse signal in order to cause preliminary vibration of the ink chamber where the partition is deformed in response to the ejection pulse signal.

10. The method according to claim 8, wherein the auxiliary pulse signal is applied to the inkjet head after the ejection pulse signal in order to absorb pressure vibration of the ink chamber from which an ink drop is ejected in response to the ejection pulse signal.

11. The method according to claim 7, wherein the auxiliary pulse signal is applied to the inkjet head before the ejection pulse signal in order to cause preliminary vibration of the ink chamber where the partition is deformed in response to the ejection pulse signal.

12. The method according to claim 7, wherein the auxiliary pulse signal is applied to the inkjet head after the ejection pulse signal in order to absorb pressure vibration of the ink chamber from which an ink drop is ejected in response to the ejection pulse signal.

* * * * *